US006651533B1

(12) United States Patent
Hsien

(10) Patent No.: US 6,651,533 B1
(45) Date of Patent: Nov. 25, 2003

(54) RATCHET WHEEL MOUNTING ARRANGEMENT FOR RATCHET WRENCHET

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/213,401

(22) Filed: Aug. 7, 2002

(51) Int. Cl.[7] ..... B25B 13/46
(52) U.S. Cl. ..... 81/60; 81/124.3; 81/180.1
(58) Field of Search ..... 81/60–63.2, 119, 81/121.1, 125, 124.3, 124.4, 124.7, 125.1, 185, 186, 180.1, 185.2

(56) References Cited

U.S. PATENT DOCUMENTS 5,230,263 A * 7/1993 Kwaka ..... 81/125.1
5,307,713 A * 5/1994 White ..... 81/180.1
6,138,533 A * 10/2000 Turtle ..... 81/124.3
6,186,032 B1 * 2/2001 Raines ..... 81/119
2001/0054334 A1 * 12/2001 Ling et al. ..... 81/124.3

* cited by examiner

*Primary Examiner*—D. S. Meislin

(57) ABSTRACT

A ratchet wheel mounting arrangement is constructed to include a wrench body with a box head, and a ratchet wheel mounted in the receiving open chamber defined within the box head of the wrench body, the wrench body having a stepped annular bottom flange fitting one side of the ratchet wrench and adapted to hold down the nut to be rotated.

1 Claim, 4 Drawing Sheets

RATCHET WHEEL MOUNTING ARRANGEMENT FOR RATCHET WRENCHET

BACKGROUND OF THE INVENTION

The present invention relates to wrenches, and more specifically, to a retractable/folding collapsible wrench, which positively holds down the nut in place when operated to rotate the nut on a screw rod.

FIG. 1 shows a ratchet wrench constructed according to the prior art. According to this structure of ratchet wrench, a retainer ring is mounted in an inside annular groove in the box end of the wrench body and adapted for stopping the nut in place, for enabling the nut to be accurately rotated with the wrench. This structure of ratchet wrench is not satisfactory in function because of the following disadvantages:

1. Complicated Assembly Procedure.

When loading the retainer ring, the user must compress the retainer ring radially inwards with the hands and then insert the radially compressed retainer ring into the inside annular groove in the box end of the wrench body. During installation of the retainer ring, the user's hands tend to be injured by the retainer ring.

2. Complicated Processing Procedure.

It is complicated to process the inside annular groove in the box end of the wrench body. The processing of the inside annular groove in the box end of the wrench body greatly increases the manufacturing cost of the ratchet wrench.

3. No Durable in Use.

When using the ratchet wrench to rotate bolts and nuts, the retainer ring tends to be damaged.

SUMMARY OF THE INVENTION

The present invention has been accomplished to provide a ratchet wheel mounting arrangement for ratchet wrench, which eliminates the aforesaid drawbacks. It is one object of the present invention to provide a ratchet wheel mounting arrangement, which is easy to assemble. It is another object of the present invention to provide a ratchet wheel mounting arrangement, which is inexpensive to manufacture. It is still another object of the present invention to provide a ratchet wheel mounting arrangement, which is durable in sue. To achieve these and other objects of the present invention, the ratchet wheel mounting arrangement comprises a wrench body with a box head, and a ratchet wheel mounted in the receiving open chamber defined within the box head of the wrench body. The wrench body has a stepped annular bottom flange fitting one side of the ratchet wrench and adapted to hold down the nut to be rotated. The stepped annular bottom flange has an inner diameter smaller than the inner diameter of the ratchet wheel. When attached to the nut to be rotated, the stepped annular bottom flange holds down the nut in place, for enabling the nut to be accurately rotated with the wrench.

DETAILED DESCRIPTION OF THE PREFERRED EMBODIMENT

Figure 1:
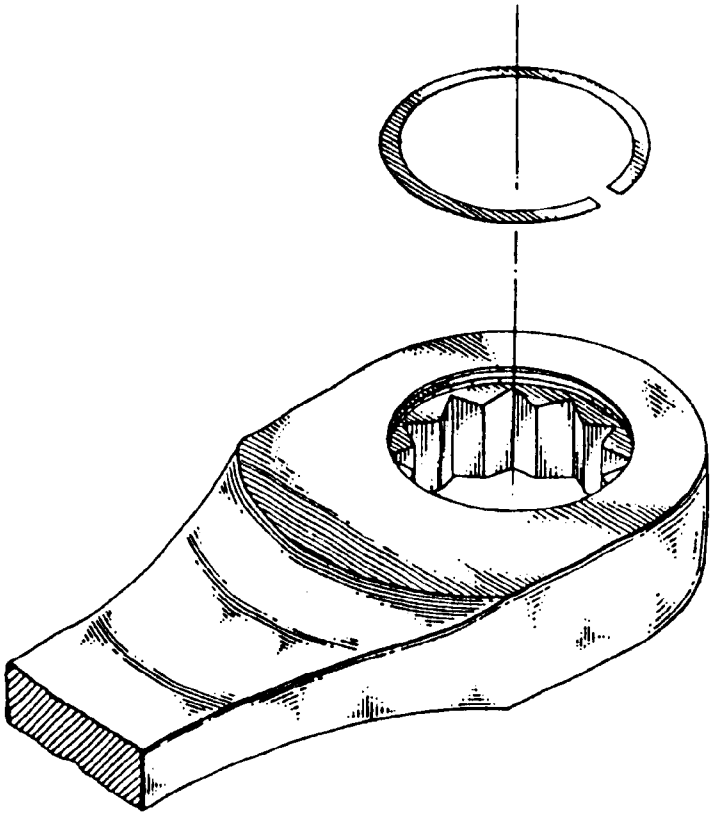
Fig. 1 PRIOR ART
FIG. 1 illustrates a ratchet wrench constructed according to the prior art.
Figure 2:
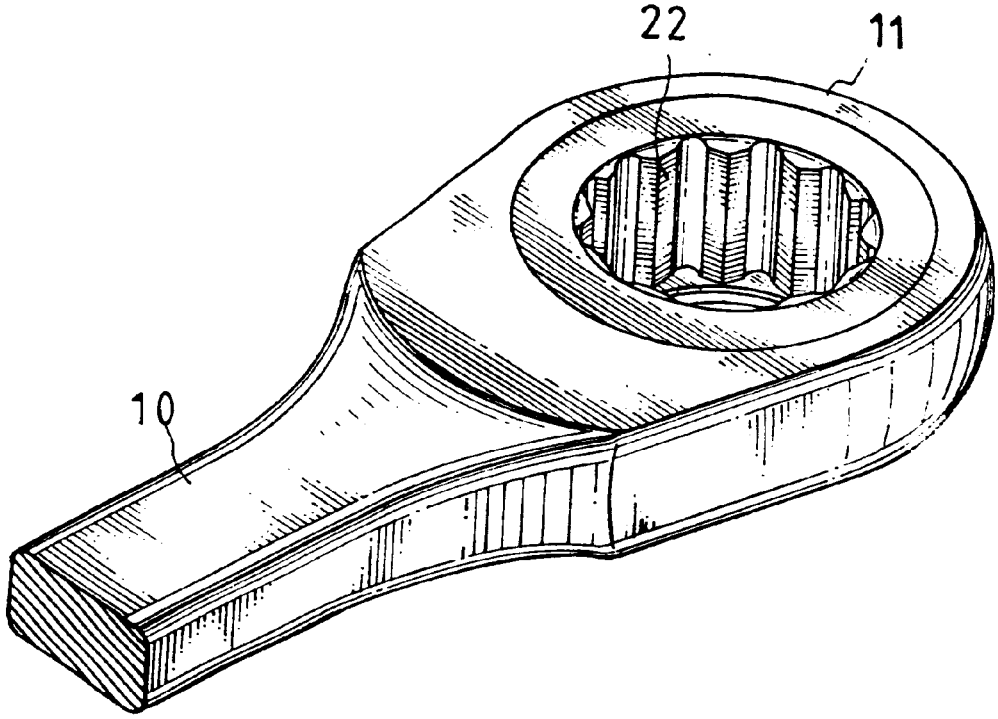
FIG. 2 is a perspective view of a ratchet wheel mounting arrangement according to the present invention.
Figure 3:
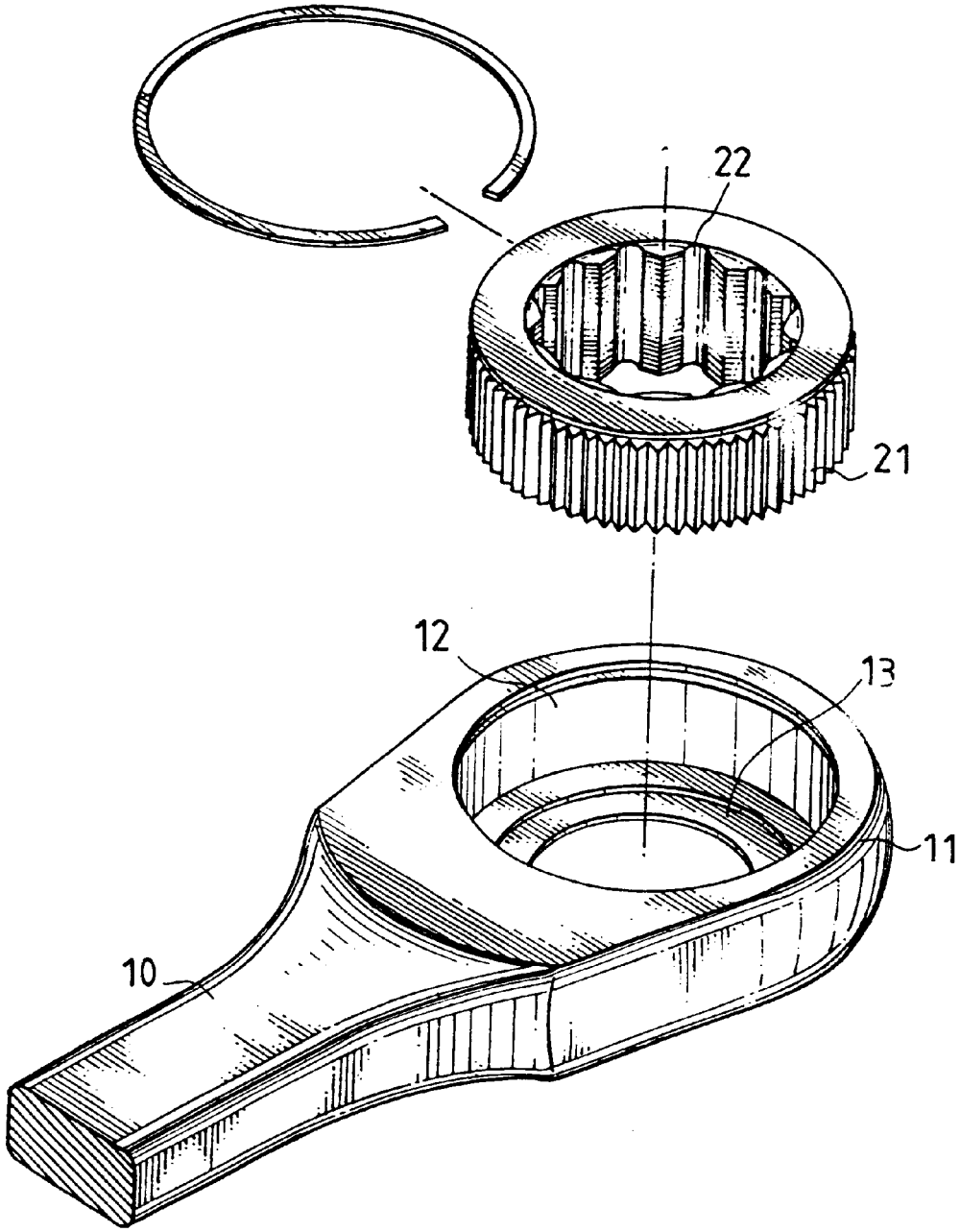
FIG. 3 is an exploded view of the ratchet wheel mounting arrangement according to the present invention.
Figure 4:
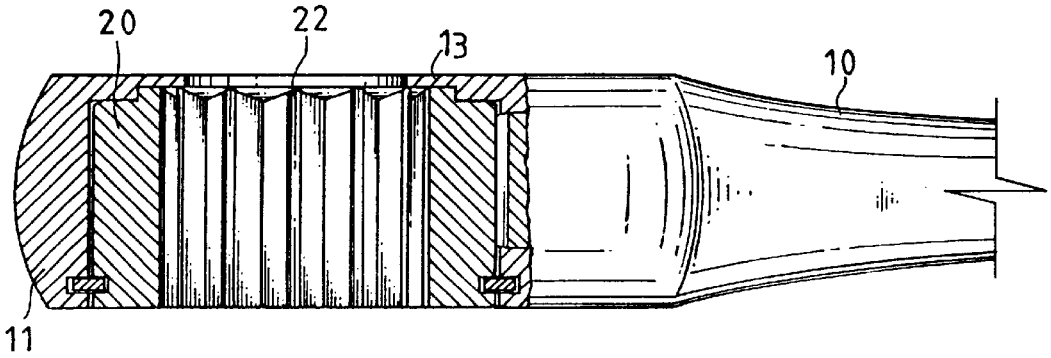
FIG. 4 is a sectional assembly view of the ratchet wheel mounting arrangement according to the present invention.

Referring to FIGS. from 2 through 4, a ratchet wheel mounting arrangement in accordance with the present invention is shown comprised of a wrench body 10, and a ratchet wheel 20.

The wrench body 10 has one end terminating in a box head 11. The box head 11 defines a circular receiving open chamber 12 and a stepped annular bottom flange 13 at one side, namely, the bottom side of the circular receiving open chamber 12. The ratchet wheel 20 is an annular wheel having a series of sloping teeth 21 arranged in parallel around the outside wall thereof and a serrated portion 22 integral with the inside wall thereof. When inserted the ratchet wheel 20 into the inside of the circular receiving open chamber 12 of the box head 11 of the wrench body 10 and secured thereto by a C-shaped retainer ring, the stepped bottom side of the ratchet wheel 20 fits the stepped annular bottom flange 13, and the inner diameter of the stepped annular bottom flange 13 covers a part of the border area of the center opening of the ratchet wheel 20.

Figure 5:
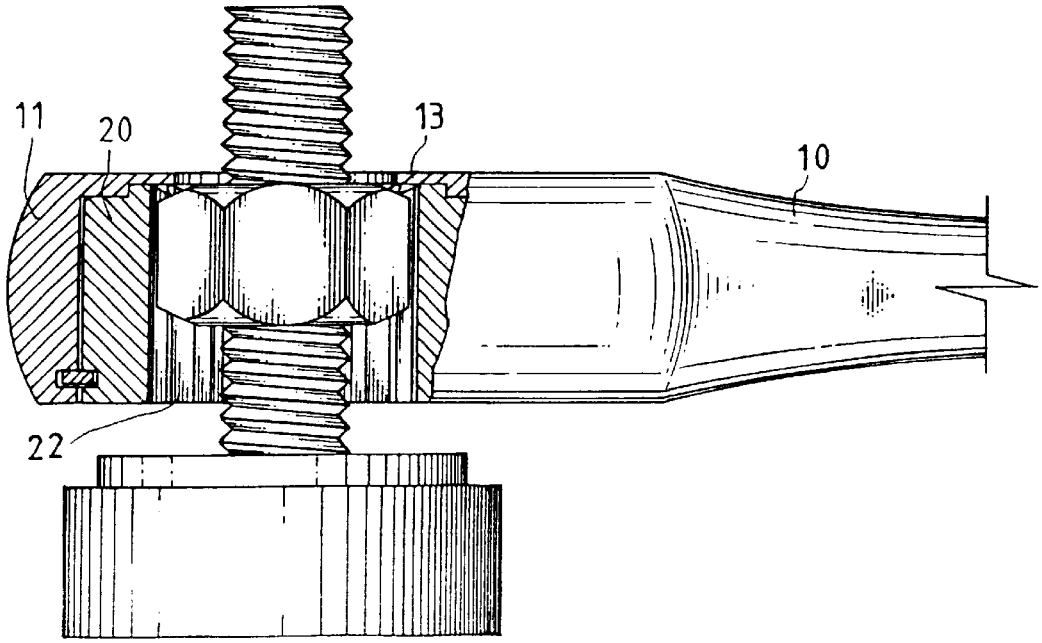
FIG. 5 illustrates an application example of the present invention.

Referring to FIG. 5, when attached to a nut at a screw rod, the screw rod extends through the center opening of the ratchet wheel 20 and the inner diameter of the stepped annular bottom flange 13 of the wrench body 10, and the stepped annular bottom flange 13 of the wrench body 10 is stopped at the top side of the nut, enabling the nut to be positively rotated with the ratchet wheel 20 and the wrench body 10.

Further, because the stepped annular bottom flange 13 is formed integral with the box head 11 of the wrench body 10, the manufacturing cost of the ratchet wrench is low.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A ratchet wheel mounting arrangement comprising a wrench body, said wrench body having one end terminating in a box head, said box head defining a circular receiving open chamber through top and bottom sides thereof, and a ratchet wheel mounted inside said circular receiving open chamber, said ratchet wheel comprising a series of sloping teeth arranged in parallel around an outside wall thereof and a serrated portion integral with an inside wall thereof and defining a center opening adapted for receiving the workpiece to be turned, wherein said box head comprises a stepped annular bottom flange disposed at one side of said circular receiving open chamber and adapted for supporting said ratchet wheel in said box head, said stepped annular bottom flange having an inner diameter smaller than the center opening defined by the serrated opening of said ratchet wheel.

* * * * *